US011473578B2

(12) United States Patent
Ahn et al.

(10) Patent No.: US 11,473,578 B2
(45) Date of Patent: Oct. 18, 2022

(54) SCROLL COMPRESSOR

(71) Applicant: Hanon Systems, Daejeon (KR)

(72) Inventors: Hyun Seong Ahn, Daejeon (KR); Hyun Jun Park, Daejeon (KR); In Cheol Shin, Daejeon (KR); Kweon Soo Lim, Daejeon (KR); Chi Myeong Moon, Daejeon (KR); Chang Eon Park, Daejeon (KR)

(73) Assignee: Hanon Systems, Daejeon (KR)

( * ) Notice: Subject to any disclaimer, the term of this patent is extended or adjusted under 35 U.S.C. 154(b) by 81 days.

(21) Appl. No.: 16/663,895

(22) Filed: Oct. 25, 2019

(65) Prior Publication Data

US 2020/0173437 A1 Jun. 4, 2020

(30) Foreign Application Priority Data

Nov. 30, 2018 (KR) ..... 10-2018-0152240

(51) Int. Cl.

| | |
|---|---|
| ***F04C 15/00*** | (2006.01) |
| ***F04C 29/02*** | (2006.01) |
| ***F04C 29/00*** | (2006.01) |
| ***F04C 18/02*** | (2006.01) |

(52) U.S. Cl.

CPC ..... *F04C 18/0215* (2013.01); *F04C 15/0065* (2013.01); *F04C 29/0057* (2013.01)

(58) Field of Classification Search

CPC ..... F04C 29/023; F04C 29/0057; F04C 18/0215; F04C 18/0246; F04C 15/0065

See application file for complete search history.

(56) References Cited

U.S. PATENT DOCUMENTS

| | | | | |
|---|---|---|---|---|
| 5,201,645 | A * | 4/1993 | Steele | F04C 29/0057 418/14 |
| 5,222,881 | A * | 6/1993 | Sano | F01C 21/02 418/55.1 |
| 5,263,822 | A * | 11/1993 | Fujio | F04C 29/025 418/55.4 |
| 2016/0169228 | A1* | 6/2016 | Jang | F04C 29/023 418/55.1 |
| 2016/0281716 | A1* | 9/2016 | Kawamura | F04C 28/06 |

FOREIGN PATENT DOCUMENTS

| | | | |
|---|---|---|---|
| JP | 2008240597 | A | 10/2008 |
| JP | 2012-067602 | A | 4/2012 |

* cited by examiner

*Primary Examiner* — Deming Wan

(74) *Attorney, Agent, or Firm* — Norton Rose Fulbright US LLP; James R. Crawford

(57) ABSTRACT

Provided is a scroll compressor which has a reduced noise vibration by minimizing an impact sound generated when the operation of the scroll compressor is stopped.

10 Claims, 10 Drawing Sheets

SCROLL COMPRESSOR

CROSS-REFERENCE(S) TO RELATED APPLICATIONS

This application claims priority to Korean Patent Application No. 10-2018-0152240, filed on Nov. 30, 2018, the disclosure of which is incorporated herein by reference in its entirety.

BACKGROUND OF THE DISCLOSURE

Field of the Disclosure

The present disclosure relates to a scroll compressor, and more particularly, to a scroll compressor which can compress refrigerant by a fixed scroll and an orbiting scroll.

Description of the Related Art

In general, a vehicle is provided with an air conditioning (A/C) device for indoor cooling and heating. Such an air conditioning device includes a compressor, as a component of a cooling system, which compresses a low-temperature low-pressure gaseous refrigerant introduced from an evaporator into a high-temperature high-pressure gaseous refrigerant and sends the compressed refrigerant to a condenser.

The compressors are classified into a reciprocating type in which a refrigerant is compressed according to the reciprocating action of a piston, and a rotary type in which compression is performed while a rotary motion is being performed. According to the transfer schemes of driving sources, the reciprocating type includes a crank type in which the transference is performed to a plurality of pistons by using a crank, a swash plate type in which the transference is performed to a rotating shaft having a swash plate mounted thereon, and the like. The rotary type includes a vane rotary type using a rotary shaft and a vane which rotate, a scroll type using an orbiting scroll and a fixed scroll.

A scroll compressor can achieve a relatively high compression ratio when compared with other types of compressor, and also a stable torque because strokes for absorption, compression, and discharge of the refrigerant are smoothly connected. Therefore, the scroll compressor is widely used for refrigerant compression in an air conditioning device and the like.

FIG. 1 is a cross-sectional diagram illustrating a conventional scroll compressor, FIG. 2 is an exploded perspective diagram illustrating a shaft and an eccentric bush in the scroll compressor of FIG. 1, and FIG. 3 is a cross-sectional diagram illustrating the shaft and eccentric bush of FIG. 2 in order to explain the operation principle thereof.

Referring to FIGS. 1 to 3, the conventional scroll compressor includes a driving source (2) generating rotational force, a shaft (31) rotating by the driving source (2), an insertion groove (3211) into which one end part of the shaft (31) is inserted, an eccentric bush (32) coupled to an one-side end part of the shaft (31) and having an eccentric part (322) by which eccentric force is generated when the shaft (31) rotates with respect to an axial direction, an orbiting scroll (41) coupled to the eccentric part (322) so as to perform an orbiting motion, and a fixed scroll (42) disposed to face the orbiting scroll (41) in an axial direction, and forming a compression chamber.

In order to prevent damage to the orbiting scroll (41) and the fixed scroll (42) due to compression of liquid refrigerant during driving, the eccentric bush (32) is formed to have a gap between the insertion groove (3211) and the radial direction outside of one end part of the shaft (31).

The eccentric bush (32) is formed such that the rotary motion of the shaft (31) is not immediately transferred to the eccentric bush (32), but is buffered and transferred according to a designed rotation gap.

However, according to the conventional scroll compressor, when the rotation speed of the shaft (31) decreases or when the rotation of the shaft (31) is stopped (turned off), the eccentric bush (32) strikes the shaft (31) due to the inertia of the eccentric bush (32) and the rotation gap between the eccentric bush (32) and the shaft (31), thereby generating an impact sound.

Since the impact sound generated by the eccentric bush (32) causes an unnecessary noise vibration of the compressor, a countermeasure against the problem is required.

RELATED ART DOCUMENT

Patent Document (Patent Document 001) Japanese Patent Laid-Open publication No. 2012-67602

SUMMARY OF THE DISCLOSURE

An object of the present disclosure is to provide a scroll compressor in which an impact sound due to friction or impact can be reduced by changing a contact area where a shaft and an eccentric bush come into contact with each other when the scroll compressor is turned off during driving.

A scroll compressor according to a first embodiment of the present disclosure includes a driving source (2) generating rotational force, a shaft (31) rotating by the driving source (2), an eccentric bush (32) coupled to an one-side end part of the shaft (31) and having an eccentric part (322) by which eccentric force is generated when the shaft (31) rotates with respect to an axial direction, an orbiting scroll (41) performing an orbiting motion in cooperation with the eccentric part (322), and a fixed scroll (42) forming a compression chamber with the orbiting scroll (41); and the shaft (31) includes a temporary contact part (31*a*) formed on an end-part outer circumferential surface such that a part of the entire end-part outer circumferential surface of the shaft (31) comes into contact with the inner circumferential surface of the eccentric bush (32) when rotation is stopped, and a non-contact part (31*b*) which does not come into direct contact with the inner circumferential surface of the eccentric bush (32).

The eccentric bush (32) has an insertion groove (3211), formed thereon, into which one end part of the shaft (31) is inserted, and a gap (G) spaced apart in a radial direction is formed between the shaft (31) and the insertion groove (3211).

The temporary contact part (31*a*) and the non-contact part (31*b*) are formed along the entire circumferential direction of the shaft (31) wherein the temporary contact part (31*a*) comes into point contact in a minimum area with the inner circumferential surface of the eccentric bush (32).

The temporary contact part (31*a*) is formed in an embossed shape which protrudes by a predetermined height from the outer circumferential surface of the shaft (31), and the non-contact part (31*b*) is intagliated with respect to the temporary contact part (31*a*).

The temporary contact part (31*a*) and the non-contact part (31*b*) are formed by a knurling process.

When the rotation of the shaft (31) is stopped, the temporary contact part (31*a*) comes into contact with the inner circumferential surface of the eccentric bush (32), and the non-contact part (31*b*) provides a passage for movement of oil in order to provide an oil film for preventing noise and impact generated when the outer circumferential surface of eccentric bush (32) and the temporary contact part (31*a*) are frictionized and come into direct contact with each other.

The temporary contact part (31*a*) is extended in a spiral shape in an axial direction at an end part of the shaft (31).

The temporary contact part (31*a*) wherein the temporary contact part is extended in an axial direction with a constant slope at an end part of the shaft.

The temporary contact part (31*a*) wherein the temporary contact part has intervals spaced between each other which are narrower in the axial direction of the shaft as the temporary contact part approaches the eccentric bush.

The temporary contact part (31*a*) wherein the temporary contact part is formed the areas are narrower as approaching the end part of the shaft.

The temporary contact part (31*a*) is divided into a plurality of portions so that oil contained in refrigerant in the entire section extending in the vertical direction in the shaft (31) moves along the shortest distance in the axial direction of the shaft (31).

The temporary contact part (31*a*) is divided at same intervals along the circumferential direction of the shaft (31), in which the divided respective temporary contact parts (31*a*) are disposed symmetrically when the shaft (31) is viewed from the front thereof.

According to a second embodiment of the present disclosure, a scroll compressor includes a driving source (2) generating rotational force, a shaft (31) rotating by the driving source (2), an eccentric bush (32) coupled to an one-side end part of the shaft (31) and having an eccentric part (322) by which eccentric force is generated when the shaft (31) rotates with respect to an axial direction, an orbiting scroll (41) performing an orbiting motion in cooperation with the eccentric part (322), and a fixed scroll (42) forming a compression chamber with the orbiting scroll (41), wherein the eccentric bush (32) includes a temporary contact part (32*c*) which is formed on the inner circumferential surface of the eccentric bush and which comes into partial contact with the entire section of the outer circumferential surface of the shaft (31) when the rotation of the shaft (31) is stopped.

DESCRIPTION OF SPECIFIC EMBODIMENTS

Hereinafter, a scroll compressor according to the present disclosure will be described in detail with reference to the accompanying drawings.

Figure 1:
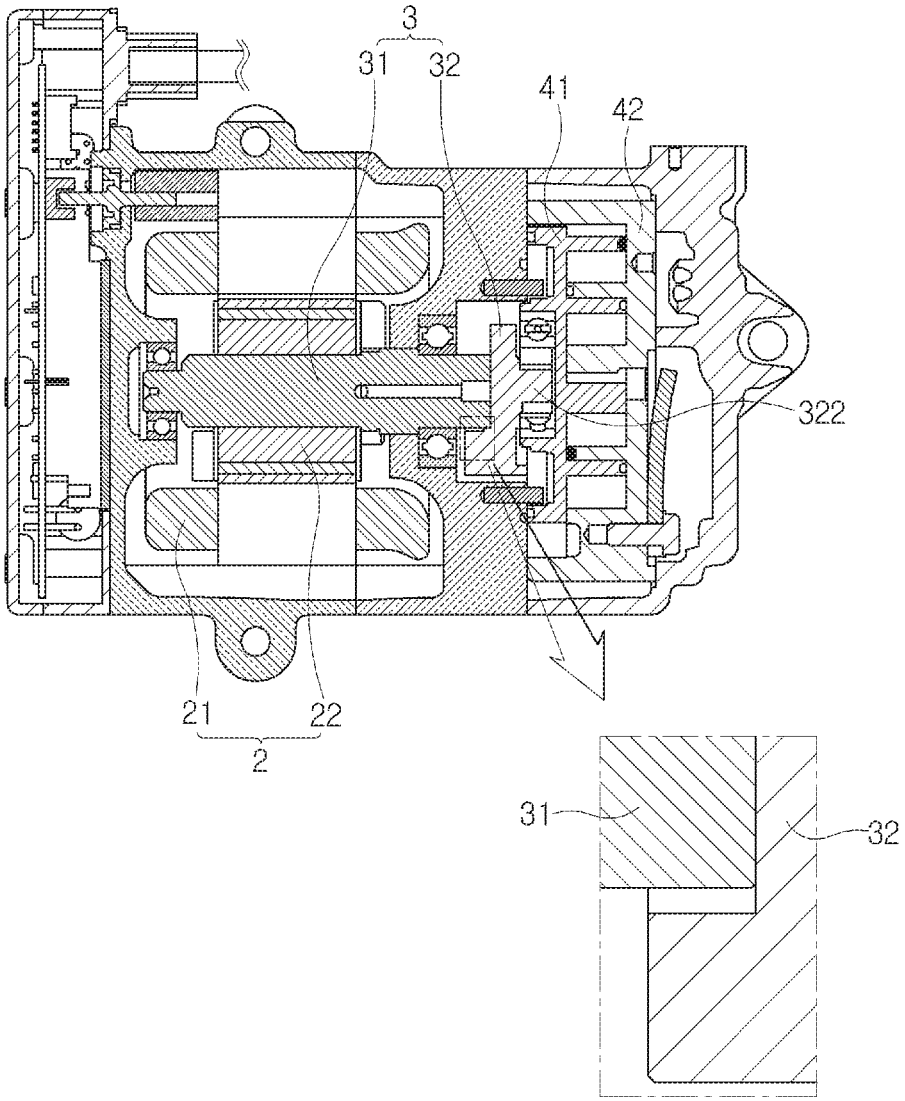
FIG. 1 is a cross-sectional diagram illustrating a conventional scroll compressor.
Figure 2:
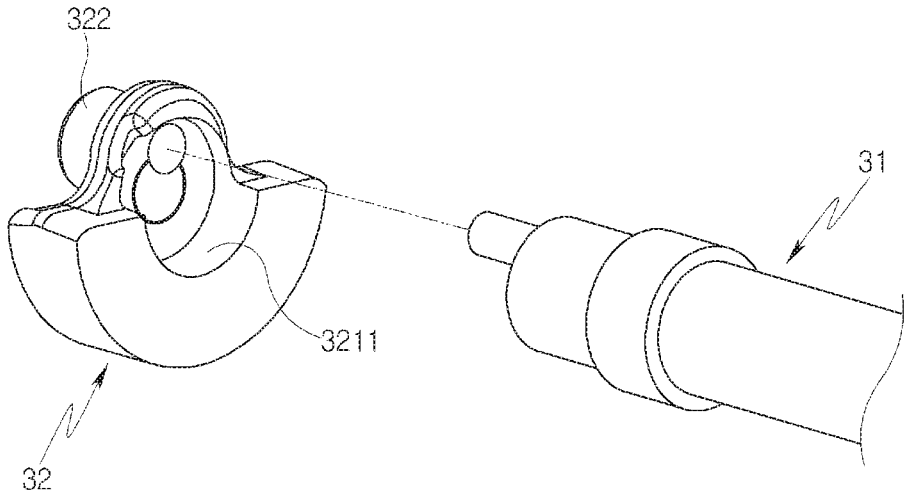
FIG. 2 is an exploded perspective diagram illustrating a shaft and an eccentric bush in the scroll compressor of FIG. 1.
Figure 3:
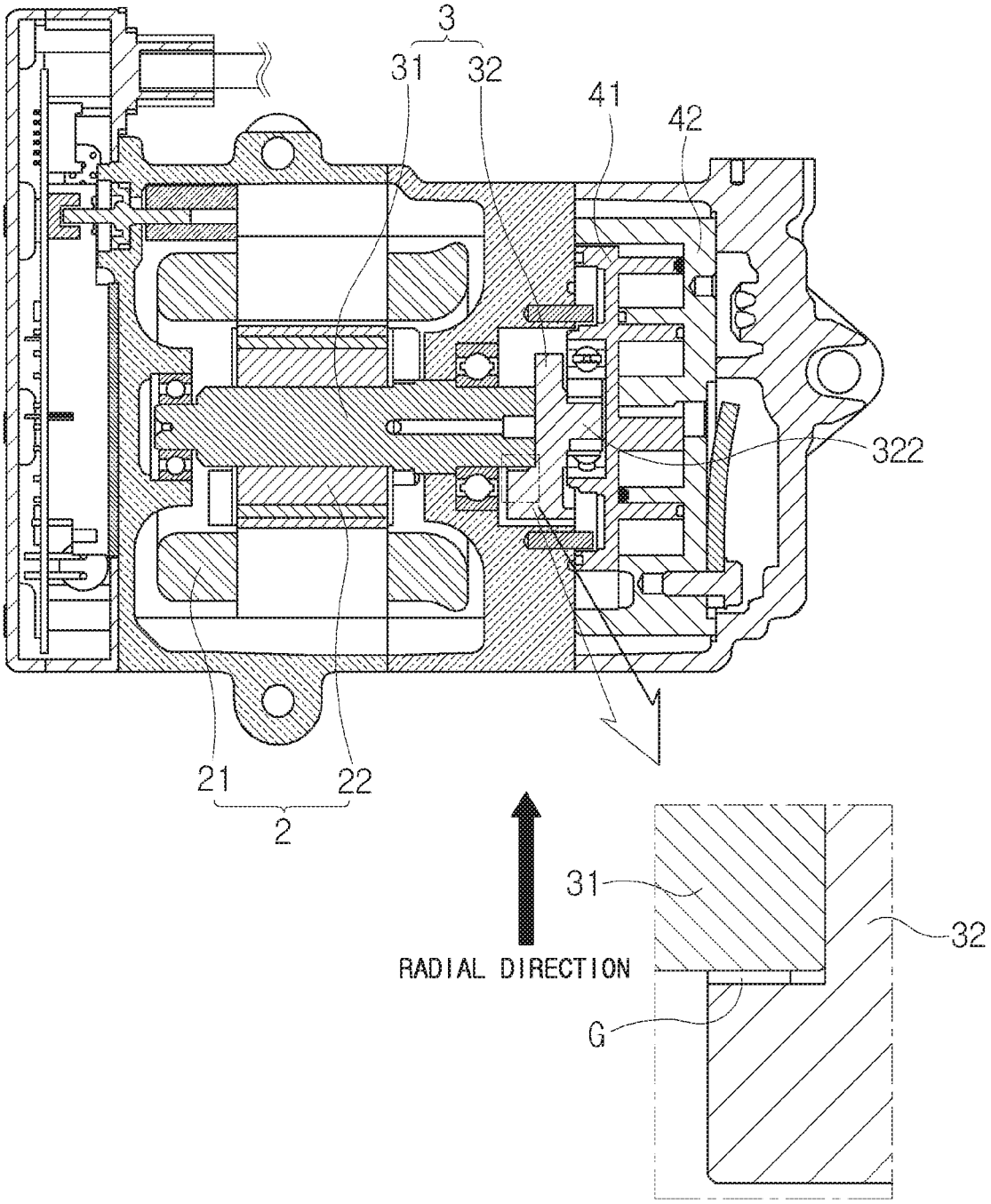
FIG. 3 is a cross-sectional diagram illustrating a scroll compressor according to a first embodiment of the present disclosure.
Figure 4:
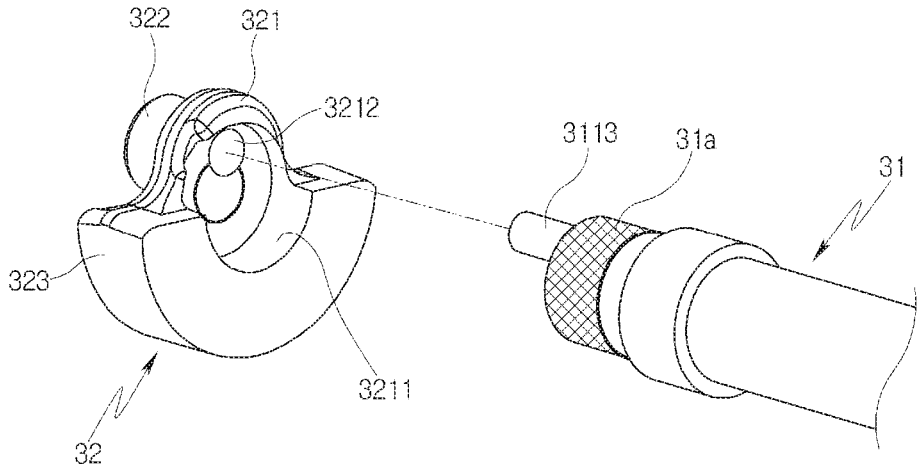
FIG. 4 is an exploded perspective diagram illustrating a shaft and an eccentric bush in the scroll compressor of FIG. 3.
Figure 5:
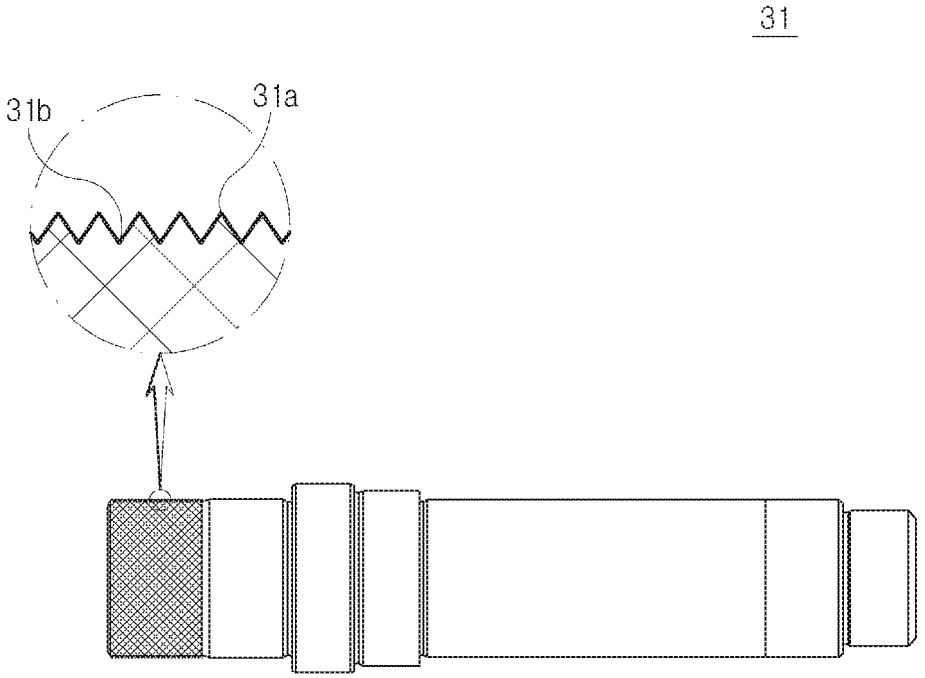
FIG. 5 is a diagram illustrating an example of a contact part and a non-contact part of the shaft illustrated in FIG. 4.

For reference, accompanying FIG. 3 is a cross-sectional diagram illustrating a scroll compressor according to a first embodiment of the present disclosure, FIG. 4 is an exploded perspective diagram illustrating a shaft and an eccentric bush in the scroll compressor of FIG. 3, and FIG. 5 is a diagram illustrating an example of a contact part and a non-contact part of the shaft illustrated in FIG. 4.

Referring to accompanying FIGS. 3 to 5, a scroll compressor according to an embodiment of the present disclosure includes a driving source (2) generating rotational force, a shaft assembly (3) rotating by the driving source (2), an orbiting scroll (41) eccentrically coupled to the shaft assembly (3) so as to perform an orbiting motion, and a fixed scroll (42) forming a compression chamber with the orbiting scroll (41).

The driving source (2) is composed of a motor which has a stator (21) and a rotor (22), and the driving source (2) is formed as a disk hub assembly cooperating with the engine of a vehicle.

The shaft assembly (3) includes a shaft (31) rotating with the rotor (22), and an eccentric bush (32) coupled to the shaft (31) so as to convert the rotary motion of the shaft (31) into an eccentric rotary motion.

The shaft (31) is formed in a cylindrical shape extending in one direction, in which one end of the shaft (31) is coupled to the eccentric bush (32), and the other end of the shaft (31) is coupled to the rotor (22).

The eccentric bush (32) includes a boss part (321) having an insertion groove (3211) into which one end part of the shaft (31) is inserted, an eccentric part (322) protruded from the boss part (321) so as to be eccentric with respect to the shaft (31), and a weight part (323) protruded from the boss part (321) to a side opposite to the eccentric part (322) in order to balance the overall rotation of the eccentric bush (32).

According to the first embodiment of the present disclosure, a gap (G) is formed in the radial direction of the shaft (31) coupled to the eccentric bush (32); and the shaft (31) includes a temporary contact part (31*a*) formed on an end-part outer circumferential surface such that a part of the entire end-part outer circumferential surface of the shaft (31) comes into contact with the inner circumferential surface of the eccentric bush (32) when rotation is stopped, and a non-contact part (31*b*) which does not come into direct contact with the inner circumferential surface of the eccentric bush (32).

The greatest technical feature of the scroll compressor according to the first embodiment of the present disclosure is that the temporary contact part (31*a*) comes into point contact in a minimum area with the inner circumferential surface of the eccentric bush (32), thereby preventing generation of noise, in order to prevent the generation of unnecessary vibration noise by minimizing an impact sound generated from a collision with the shaft (31) by the rotational force of the eccentric bush (32) when the shaft (31) is turned off during operation.

According to the present embodiment, the shaft (31) is formed in a cylindrical shape and extends with a constant external diameter in a longitudinal direction with respect to the drawings. In addition, a coupling pin (3113) for coupling with the eccentric bush (32) is formed on an end of the shaft extending toward the eccentric bush (32).

The coupling pin (3113) is located to be eccentric to an outer side in the radial direction from the center of the rotating shaft of the shaft (31). The coupling pin (3113) is formed in a cylindrical shape having a predetermined diameter, and extends toward the eccentric bush (32) by a length illustrated in the drawings.

The insertion groove (3211) formed in the eccentric bush (32) is formed in a cylindrical shape such that the shaft (31) can rotate in the insertion groove (3211), and the insertion groove (3211) is formed to have an internal diameter greater than the external diameter of the end part of the shaft (31).

Since the eccentric bush (32) has an insertion groove (3211), formed thereon, into which one end part of the shaft (31) is inserted, and a gap (G) spaced apart in a radial direction is formed between the shaft (31) and the insertion groove (3211), a state of being spaced apart by a predetermined distance is maintained when the shaft (31) rotates.

A dimension difference between the internal diameter of the insertion groove (3211) and an external diameter corresponding to one end part of the shaft (31) is determined such that the shaft (31) can rotate in the insertion groove (3211), and the shaft (31) can come into contact with and be supported on the inner circumferential surface of the insertion groove (3211) when the shaft (31) has rotated by a predetermined angle.

A coupling groove (3212) is formed at a position spaced apart outward in a radial direction from the insertion groove (3211) so as to correspond to the coupling pin (3113) which is eccentric with respect to the shaft (31).

In addition, the coupling groove (3212) is formed in a cylindrical shape from the base surface of the insertion groove (3211) such that the coupling pin (3113) can rotate therein, in which the coupling groove (3212) is formed to have an internal diameter greater than the external diameter of the coupling pin (3113).

According to the present embodiment, the temporary contact part (31*a*) and the non-contact part (31*b*) are formed on the end-part outer circumferential surface of the shaft (31) so as to minimize an impact sound which is generated as the eccentric bush (32) collides with the shaft (31) when the rotation of the shaft (31) is stopped.

The temporary contact part (31*a*) and the non-contact part (31*b*) are formed along the entire circumferential direction of the shaft (31) wherein the temporary contact part (31*a*) comes into point contact in a minimum area with the inner circumferential surface of the eccentric bush (32).

Since the contact area between the temporary contact part (31*a*) and the inner circumferential surface of the eccentric bush (32) is minimized, the amounts of vibration and noise which is generated by contact or collision between the temporary contact part (31*a*) and the inner circumferential surface of the eccentric bush (32) when the operation of the scroll compressor is stopped is minimized, so that the conventional problem caused when the operation of the conventional swash plate-type compressor is stopped can be solved.

The temporary contact part (31*a*) is formed in an embossed shape which protrudes by a predetermined height from the outer circumferential surface of the shaft (31), and the non-contact part (31*b*) is intagliated with respect to the temporary contact part (31*a*).

The temporary contact part (31*a*) can be transformed to shapes other than the shapes illustrated in the drawings, and is not particularly limited to a specific shape.

The temporary contact part (31*a*) and the non-contact part (31*b*) are formed by a knurling process, and in this case, the processing for the shaft (31) can be rapidly performed by a machine tool (not shown). In addition, the processability of the shaft (31) is improved, there is a further advantage in mass production, and an operation cost for the processing is also minimized, so that there is an economic advantage.

Since the temporary contact part (31*a*) is formed along the entire circumferential direction, vibration and noise by contact or collision can be reduced through point contact even when the temporary contact part (31*a*) comes into contact with any portion of the area of the inner circumferential surface of the eccentric bush (32).

According to the present embodiment, when the rotation of the shaft (31) is stopped, the temporary contact part (31*a*) comes into point contact with the insertion groove (3211) which is the inner circumferential surface of the eccentric bush (32), and the non-contact part (31*b*) provides a passage for movement of oil to provide an oil film which prevents noise and collision generated when the temporary contact part (31*a*) is frictionized and comes into direct contact with the insertion groove (2111).

Since the scroll compressor contains predetermined oil in refrigerant in the inside where the shaft (31) is located, oil moves in an axial direction when the shaft (31) rotates.

Since an end part of the shaft (31) necessarily comes into contact with the inner circumferential surface of the eccentric bush (32), supplying oil for lubrication to the temporary contact part (31*a*) so as to prevent a break down due to abrasion or friction by contact is advantageous for a stable operation.

To this end, according to the present embodiment, predetermined oil is more stably supplied to the inner circumferential surface of the eccentric bush (32) by using the shape of the non-contact part (31*b*), so that an oil film having a predetermined thickness can be formed between the surface of the temporary contact part (31*a*) and the inner circumferential surface of the eccentric bush (32). For reference, the inner circumferential surface of the eccentric bush (32) corresponds to the insertion groove (3211).

The oil film is not restricted to a specific thickness, but a predetermined amount of oil should be supplied to the temporary contact part (31*a*) and the inner circumferential surface of the eccentric bush (32) at all times by the non-contact part (31*b*) formed in a groove shape.

Accordingly, since oil is constantly supplied to the temporary contact part (31*a*) and the inner circumferential surface of the eccentric bush (32), and an oil film for lubrication is constantly maintained at all times, a collision sound caused by direct contact or collision between the temporary contact part (31*a*) and the eccentric bush (32) is reduced, thereby minimizing noise and vibration.

Figure 6:
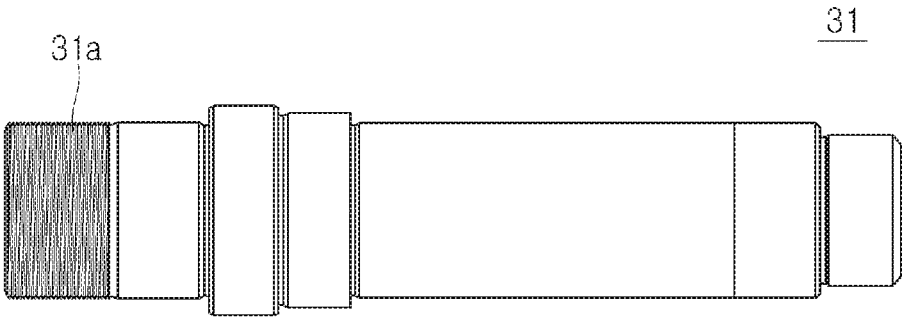
FIGS. 6 to 12 are diagrams illustrating various embodiments of a contact part formed on the shaft.

Referring to FIG. 6, according to the present embodiment, a temporary contact part (31*a*) is extended in a spiral shape in an axial direction at an end part of a shaft (31). Since the temporary contact part (31*a*) is extended in a spiral shape, differently from that in the aforementioned embodiment, oil does not fast move to the end part of the shaft (31) or the inner circumferential surface of the eccentric bush (32) along the non-contact part (31*b*), but a predetermined amount of oil is uniformly supplied at all times.

In addition, after oil is supplied to the temporary contact part (31*a*) or the inner circumferential surface of the eccentric bush (32), the oil does not fast move, and fast movement of the oil is prevented by a shape in which the non-contact part (31*b*) is disposed.

In this case, oil remains on the inner circumferential surface of the eccentric bush (32) and the temporary contact part (31*a*) at all times, which enables stable lubrication, particularly by preventing destruction of an oil film by lack of oil when the operation of the scroll compressor is stopped and then restarts.

Therefore, since an oil film is constantly maintained on the temporary contact part (31*a*) and the inner circumferential surface of the eccentric bush (32), the generation of noise and impact due to direct contact or collision can be minimized.

Figure 7:
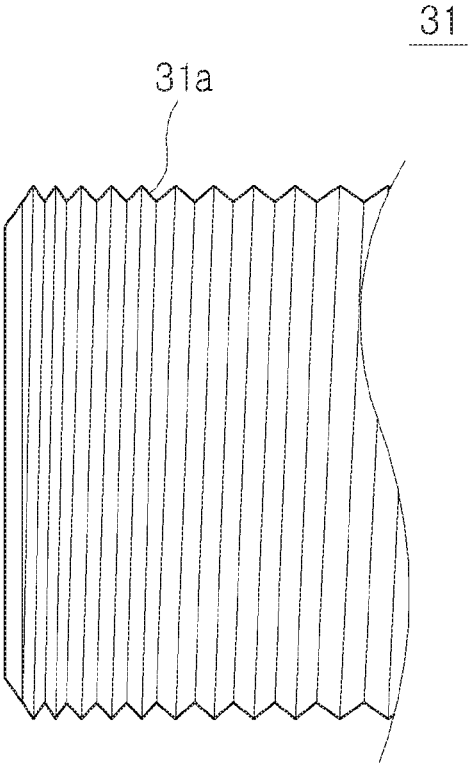

Referring to FIG. 7, according to the present embodiment, a temporary contact part (31*a*) can be configured such that intervals spaced between each other are narrower in the axial direction of the shaft (31) as the temporary contact part (31*a*) approaches the eccentric bush (32).

In the case where the temporary contact part (31*a*) is formed in such a way, when the shaft (31) is turned off during operation, an impact sound caused by collision with the shaft (31) due to the rotational force of the eccentric bush (32) is minimized while the temporary contact part (31*a*) comes into point contact with the insertion groove (3211) corresponding to the inner circumferential surface of the eccentric bush (32).

In addition, oil contained in refrigerant moves in the axial direction of the shaft (31) and then lubricates on the inner circumferential surface of the eccentric bush (32) for a predetermined period of time, wherein the structure of the temporary contact part (31*a*) having spaced intervals which are narrower forms more amount of oil between the shaft (31) and the inner circumferential surface of the eccentric bush (32).

Accordingly, even when the shaft (31) collides with the inner circumferential surface of the eccentric bush (32), noise is reduced, and also an oil film is stably maintained.

Figure 8:
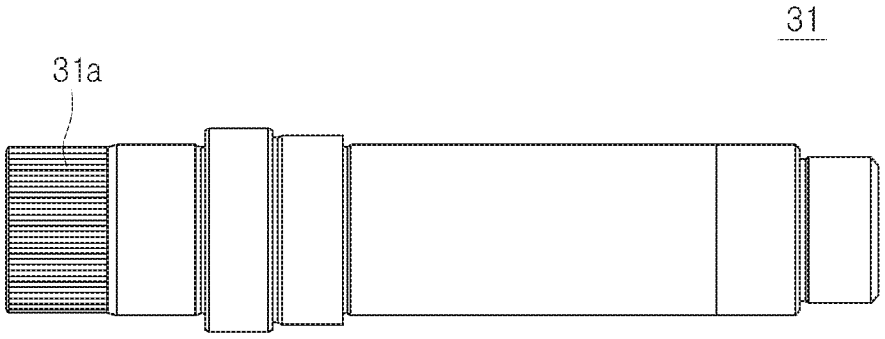

Referring to FIG. 8, according to the present embodiment, a temporary contact part (31*a*) is extended in a horizontal direction along an axial direction at an end part of a shaft (31). For reference, the horizontal direction is defined to be the axial direction of the shaft (31).

When the temporary contact part (31*a*) is extended as illustrated in the drawing, oil can move to the eccentric bush (32), so that a constant amount of oil is supplied to the temporary contact part (31*a*) and the eccentric bush (32) at all times.

In addition, since a probability that an oil film is destroyed due to lack of oil on the temporary contact part (31*a*) and the inner circumferential surface of the eccentric bush (32) is reduced, an impact sound due to contact is reduced.

The temporary contact part (31*a*) is extended by a predetermined length from an axial-direction end part of the shaft (31), and oil moves in an axial direction with respect to the drawing. For example, the eccentric bush (32) moves to a left-side end part with respect to the drawing.

In this case, since oil constantly moves to the eccentric bush (32) at all times, an impact sound caused when the operation of the scroll compressor is stopped is reduced. In addition, even when the operation of the scroll compressor is stopped and then restarts, an oil film is maintained on the temporary contact part (31*a*) and the inner circumferential surface of the eccentric bush (32), so that lubrication and noise reduction can be both achieved.

Figure 9:
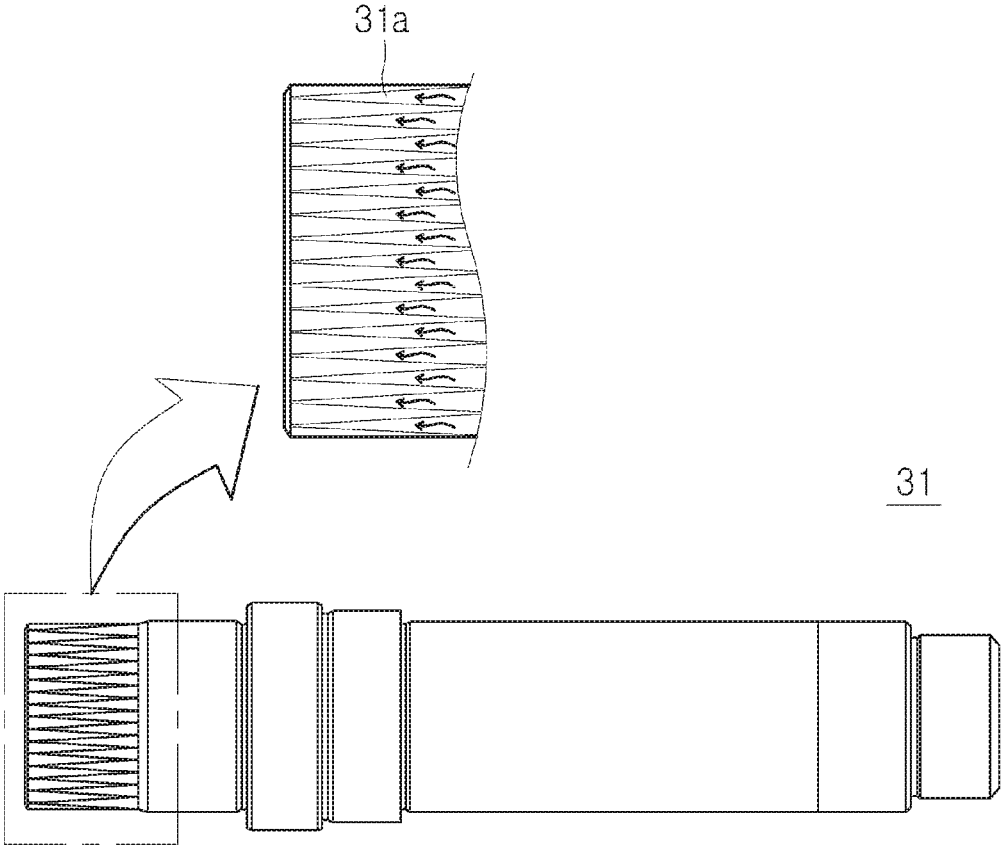

Referring to FIG. 9, according to the present embodiment, a temporary contact part (31*a*) is extended to be inclined from an axial-direction one side of the shaft (31) toward the other-side end part where the eccentric bush (32) is formed.

When the temporary contact part (31*a*) is formed in such a way, oil contained in refrigerant is faster supplied in the axial direction of the shaft (31), as illustrated as arrows.

For example, since the temporary contact part (31*a*) is formed as nozzles of which the areas are narrower as approaching the end part of the shaft (31) with respect to the drawing, oil for lubrication is stably supplied at all times, and a small amount of oil can also be rapidly supplied to the inner circumferential surface of the eccentric bush (32).

Figure 10:
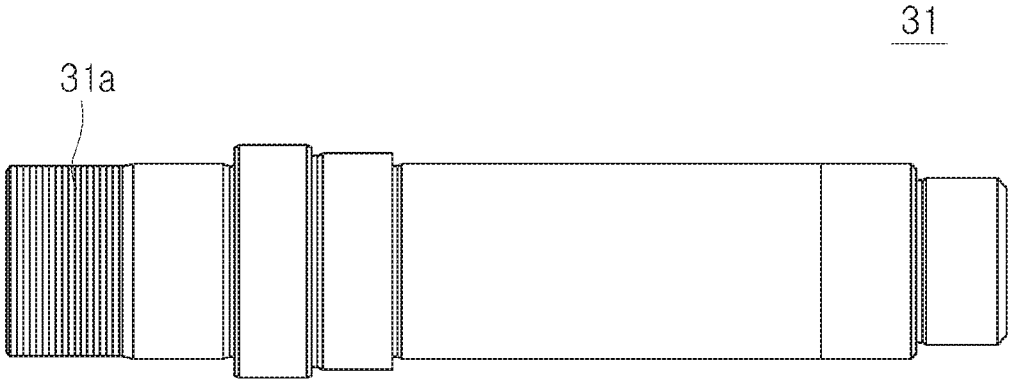

Referring to FIG. 10, according to the present embodiment, a temporary contact part (31*a*) is extended in a vertical direction on an end part of a shaft (31). The present embodiment shows a disposition similar to the spiral shape illustrated in FIG. 6, wherein when the temporary contact part (31*a*) is extended as illustrated in the drawing, oil remains in the circumferential direction of the shaft (31) with respect to the drawing.

In this case, since oil remains on the temporary contact part (31*a*), which comes into point contact, at all times, and oil remains or an oil film is stably maintained even on the inner circumferential surface of the eccentric bush (32) which comes into point contact with the temporary contact part (31*a*), an impact sound caused when the operation of the scroll compressor is stopped is reduced.

Accordingly, according to the aforementioned various embodiments of the temporary contact part (31*a*), an oil film is stably formed on the eccentric bush (32) and the temporary contact part (31*a*), so that an impact sound by point contact is minimized, and the oil film can be stably maintained.

Figure 11:
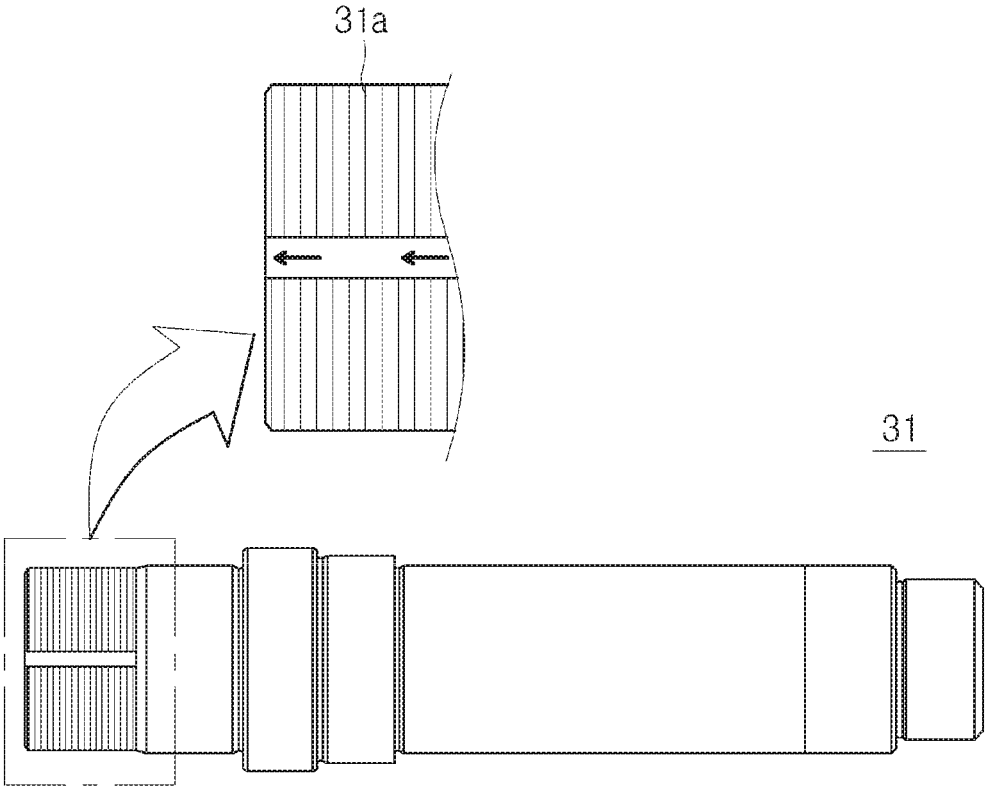

Referring to FIG. 11, according to the present embodiment, a temporary contact part (31*a*) is divided into a plurality of portions so that oil contained in refrigerant in the entire section extending in the vertical direction in the shaft (31) moves along the shortest distance in the axial direction of the shaft (31).

The oil contained in the refrigerant flows in the circumferential direction of the shaft (31) because of the structural feature wherein the temporary contact part (31*a*) is formed in the vertical direction of the shaft (31), and the oil moves to an end part of the shaft (31) along the shortest distance in the arrow direction because the temporary contact part (31*a*) is divided as illustrated in the drawing.

In this case, since a constant amount of oil is supplied to the inner circumferential surface of the eccentric bush (32) at all times, the thickness of an oil film is not thinned but is stably maintained, and the generation of noise is minimized even when a collision with the shaft (31) occurs.

Figure 12:
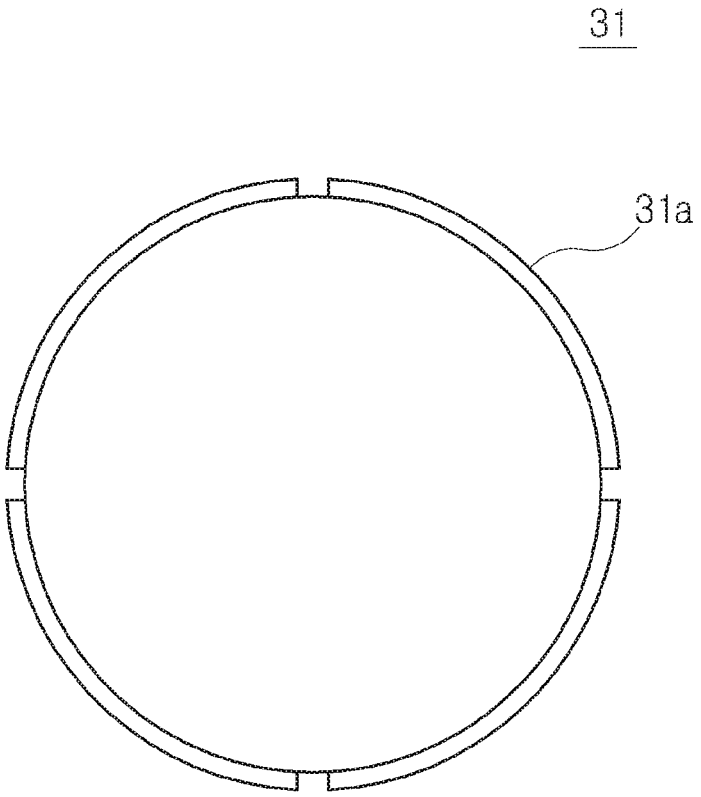

Referring to FIG. 12, a temporary contact part (31*a*) is divided at same intervals along the circumferential direction of the shaft (31), in which the divided respective temporary contact parts (31*a*) are disposed symmetrically when the shaft (31) is viewed from the front thereof.

For example, the division is performed at positions of the 12 o'clock, 3 o'clock, 6 o'clock and 9 o'clock directions with respect to the clockwise rotation so as to have an up/down/left/right symmetry. In this case, since oil contained in refrigerant is supplied to the inner circumferential surface of the eccentric bush (32) in multiple directions at mutually separated positions, an oil film is constantly maintained at all times even when the shaft (31) is stopped at a specific position during rotation.

In addition, even when a collision with the shaft (31) occurs, generation of noise is minimized.

A scroll compressor according to a second embodiment of the present disclosure will be described with reference to the drawings.

Figure 13:
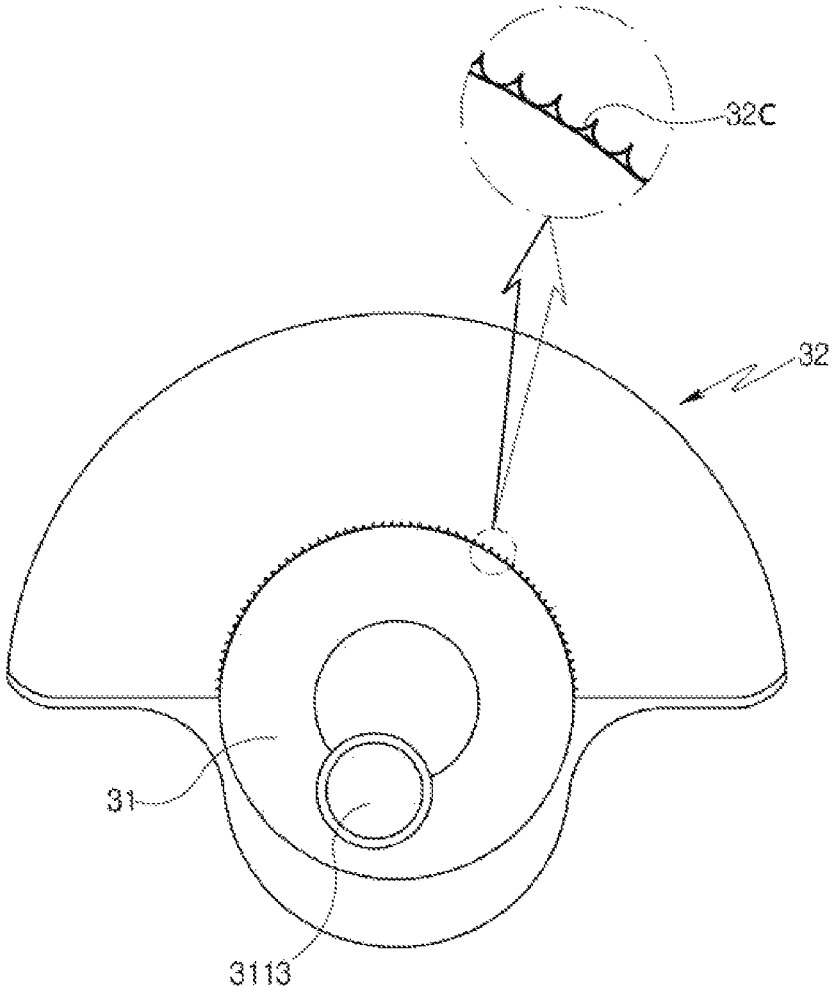
FIG. 13 is a diagram illustrating a shaft and an eccentric bush in a scroll compressor according to a second embodiment of the present disclosure.

Referring to FIGS. 3 and 13, a scroll compressor according to the present embodiment includes a driving source (2) generating rotational force, a shaft (31) rotating by the driving source (2), an eccentric bush (32) coupled to an one-side end part of the shaft (31) and having an eccentric part (322) by which eccentric force is generated when the shaft (31) rotates with respect to an axial direction, an orbiting scroll (41) performing an orbiting motion in cooperation with the eccentric part (322), and a fixed scroll (42) forming a compression chamber with the orbiting scroll (41), wherein the eccentric bush (32) includes a temporary contact part (32*c*) which is formed on the inner circumferential surface of the eccentric bush and which comes into partial contact with the entire section of the outer circumferential surface of the shaft (31) when the rotation of the shaft (31) is stopped.

Differently from the aforementioned first embodiment, the second embodiment is configured such that the temporary contact part (32*c*) is formed on the inside of the eccentric bush (32). The temporary contact part (32*c*) protrudes by a predetermined height in a circumferential direction, and comes into point contact with an end part of the shaft (31).

When point contact is made as descried above, an impact sound less than that in the conventional compressor is generated, so that noise can be reduced.

Since the temporary contact part (32*c*) comes into point contact in a minimum area with the outer circumferential surface of the shaft (31), reduction of an impact sound can be achieved through reduction of a contact area.

A scroll compressor according to a third embodiment of the present disclosure will be described with reference to the drawings.

Figure 14:
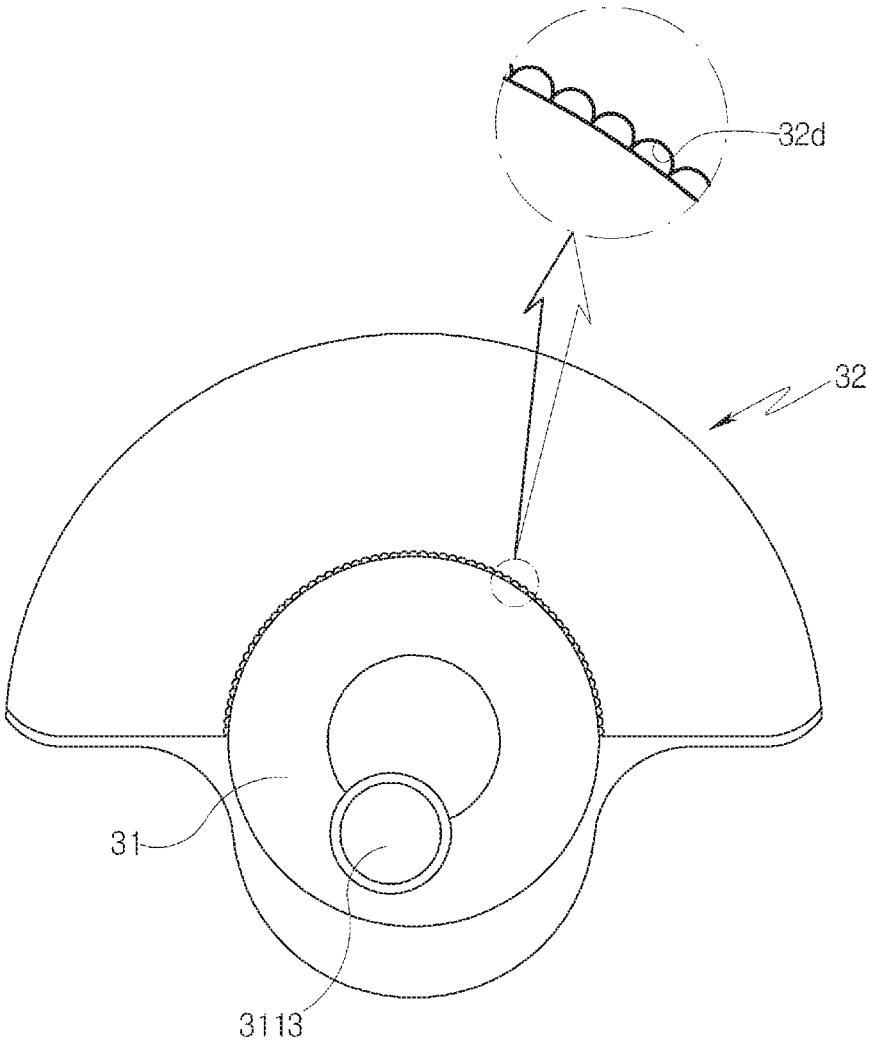
FIG. 14 is a diagram illustrating a shaft and an eccentric bush in a scroll compressor according to a third embodiment of the present disclosure.

Referring to FIGS. 3 and 14, a scroll compressor according to the present embodiment includes a driving source (2) generating rotational force, a shaft (31) rotating by the driving source (2), an eccentric bush (32) coupled to an one-side end part of the shaft (31) and having an eccentric part (322) by which eccentric force is generated when the shaft (31) rotates with respect to an axial direction, an orbiting scroll (41) performing an orbiting motion in cooperation with the eccentric part (322), and a fixed scroll (42) forming a compression chamber with the orbiting scroll (41), wherein the eccentric bush (32) includes a groove part (32*d*) which is formed on the inner circumferential surface of the eccentric bush and which comes into partial contact with the entire section of the outer circumferential surface of the shaft (31) when the rotation of the shaft (31) is stopped.

Differently from the temporary contact part (32*c*) according to the aforementioned second embodiment, groove parts (32*d*) can minimize an impact sound generated when the operation of the scroll compressor is stopped, through point contact with the outer circumferential surface of the shaft (31) at positions where one groove part (32*d*) and one groove part (32*d*) are connected to each other.

Therefore, according to the present embodiment, generation of unnecessary noise caused according to the operation or operation stop of the scroll compressor is minimized to minimize deformation due to impact and thus to achieve a stable operation.

The scroll compressor according to the present embodiments is intended to change the magnitude and tone of an impact sound by changing a contact area between a shaft and an eccentric bush.

The scroll compressor according to the present embodiments minimizes, through a simple processing, an impact sound generated between a shaft and an eccentric bush, so that generation of noise is reduced, and deformation or damage due to collision between the shaft and the eccentric bush can be minimized, thereby improving the durability thereof.

As described above, although the present disclosure has been described with reference to the limited embodiments and drawings, it should be understood that the present disclosure is not limited thereto and various modifications and deformations can be made by those skilled in the art to which the present disclosure pertains within the technical spirit of the present disclosure and the equivalent scope of the appended claims.

What is claimed is:

1. A scroll compressor, comprising:

a driving source generating rotational force;

a shaft rotating by the driving source;

an eccentric bush coupled to an one-side end part of the shaft and having an eccentric part by which eccentric force is generated when the shaft rotates with respect to an axial direction;

an orbiting scroll performing an orbiting motion in cooperation with the eccentric part; and a fixed scroll forming a compression chamber with the orbiting scroll, wherein the shaft comprises a multiple temporary contact parts formed on an end-part outer circumferential surface such that a part of the entire end-part outer circumferential surface of the shaft comes into contact with the inner circumferential surface of the eccentric bush when rotation is stopped, and a multiple non-contact parts which does not come into direct contact with the inner circumferential surface of the eccentric bush, and wherein the multiple temporary contact parts and the multiple non-contact parts are formed along the entire circumferential direction of the shaft, in which the multiple temporary contact parts comes into point contact with the inner circumferential surface of the eccentric bush, wherein the multiple temporary contact parts and the multiple non-contact parts are formed together in a predetermined section along the axial direction and the cylindrical direction of the shaft, and the multiple non-contact parts are provided simultaneously provides a passage for movement of oil in a predetermined section along the axial and circumferential directions of the shaft.

2. The scroll compressor of claim 1, wherein the eccentric bush has an insertion groove, formed thereon, into which one end part of the shaft is inserted, and a gap (G) spaced apart in a radial direction is formed between the shaft and the insertion groove.

3. The scroll compressor of claim 1, wherein the multiple temporary contact parts is formed in an embossed shape which protrudes by a predetermined height from the outer circumferential surface of the shaft, and the multiple non-contact parts is intagliated with respect to the temporary contact part.

4. The scroll compressor of claim 1, wherein the multiple temporary contact parts and the multiple non-contact parts are formed by a knurling process.

5. The scroll compressor of claim 1, wherein the temporary contact part is extended in a spiral shape in an axial direction at an end part of the shaft.

6. The scroll compressor of claim 5, wherein the temporary contact part has intervals spaced between each other which are narrower in the axial direction of the shaft as the temporary contact part approaches the eccentric bush.

7. The scroll compressor of claim 1, wherein the temporary contact part is extended in an axial direction with a constant slope at an end part of the shaft.

8. The scroll compressor of claim 7, wherein the temporary contact part is divided into a plurality of portions so that oil contained in refrigerant in the entire section extending in the vertical direction in the shaft moves along the shortest distance in the axial direction of the shaft.

9. The scroll compressor of claim 8, wherein the temporary contact part is divided at intervals along the circumferential direction of the shaft, in which the divided respective temporary contact parts are disposed symmetrically when the shaft is viewed from the front thereof.

10. The scroll compressor of claim 1, wherein the temporary contact part is formed the areas are narrower as approaching the end part of the shaft.

* * * * *